United States Patent [19]

Castleberry et al.

[11] Patent Number: 4,564,962

[45] Date of Patent: Jan. 21, 1986

[54] ENERGY EFFICIENT THERMOSYPHONING SPA HEATER SYSTEM

[76] Inventors: Kenneth B. Castleberry, 2833 NW. 12th Ave., Albany, Oreg. 97321; Norman L. McDonald, 4316 Riverside Rd. South, Salem, Oreg. 97306

[21] Appl. No.: 741,726

[22] Filed: Jun. 6, 1985

Related U.S. Application Data

[63] Continuation of Ser. No. 497,693, May 24, 1983, abandoned.

[51] Int. Cl.[4] ..... A61H 33/02

[52] U.S. Cl. ..... 4/543; 219/297

[58] Field of Search ..... 4/492, 493, 524, 542, 4/543-545; 128/66; 219/297, 306

[56] References Cited

U.S. PATENT DOCUMENTS

| | | | |
|---|---|---|---|
| 1,617,889 | 2/1927 | Woodgate et al. | 219/297 |
| 2,228,004 | 1/1941 | Ewing | 219/306 |
| 2,577,694 | 12/1951 | Winn | 219/297 |
| 3,400,246 | 9/1968 | Zob | 219/306 X |
| 3,571,818 | 3/1971 | Jacuzzi | 4/542 |
| 4,339,833 | 7/1982 | Mandell | 4/542 |

*Primary Examiner*—Charles E. Phillips
*Attorney, Agent, or Firm*—Charles N. Hilke

[57] ABSTRACT

In a spa a thermosyphoning unit is attached in upright position on the spa shell where such unit comprises an upward flowing cold inlet pipe, a heating pipe, an upward flowing hot outlet pipe, and a heating element. A one speed pump is required. Water is drawn from the spa to the pump through a drain, skimmer, cold inlet pipe and hot outlet pipe. A thermostat controls the operation of the heating element in conjunction with a high limit switch to prevent over heating the water. The spa is completely insulated with a removable insulated top on the spa.

4 Claims, 3 Drawing Figures

ENERGY EFFICIENT THERMOSYPHONING SPA HEATER SYSTEM

BACKGROUND OF THE INVENTION

This is a continuation of copending application Ser. No. 497,693 filed on May 24, 1983 now abandoned.

1. Field of the Invention

The invention relates generally to spas and, more particularly to the heating system and pumping system of spas.

2. Description of Prior Art

Modern spas available today incorporate the heating unit within the pump system. Thus, it is necessary to have a two speed pump which works continuously at low speed when the spa is not in use and at a higher speed when the spa is in use. This invention eliminates the need for a two speed pump by using the well known effect of thermosyphoning or stratification of water by temperature. See U.S. Pat. No. 2,228,004; U.S. Pat. No. 2,577,694; U.S. Pat. No. 3,400,246.

SUMMARY OF THE INVENTION

It is an object of this invention to provide an energy efficient spa.

It is a further object of this invention to reduce the installation, operating, and replacement costs of the parts of the spa.

Another further object is to provide increased safety when the pump is operating.

Another further object is to provide more reliable spa heating requiring less service and maintenance.

A final object is to reduce the amount of space needed for a spa.

A thermosyphoning unit attached in upright position along the spa shell contains a heating element independently operable from the spa pump. The thermosyphoning unit comprises a cold inlet pipe slanting upward, a heating pipe slanting upward, a hot outlet pipe slanting upward, a heating element, and a heat base. The thermosyphoning unit operates independently of the pump. Furthermore, the pump is a one speed pump only which, in operation, draws water from four intakes, i.e. the drain, the skimmer, cold inlet pipe, and hot outlet pipe.

DETAILED DESCRIPTION OF THE PREFERRED EMBODIMENT

Figure 1:
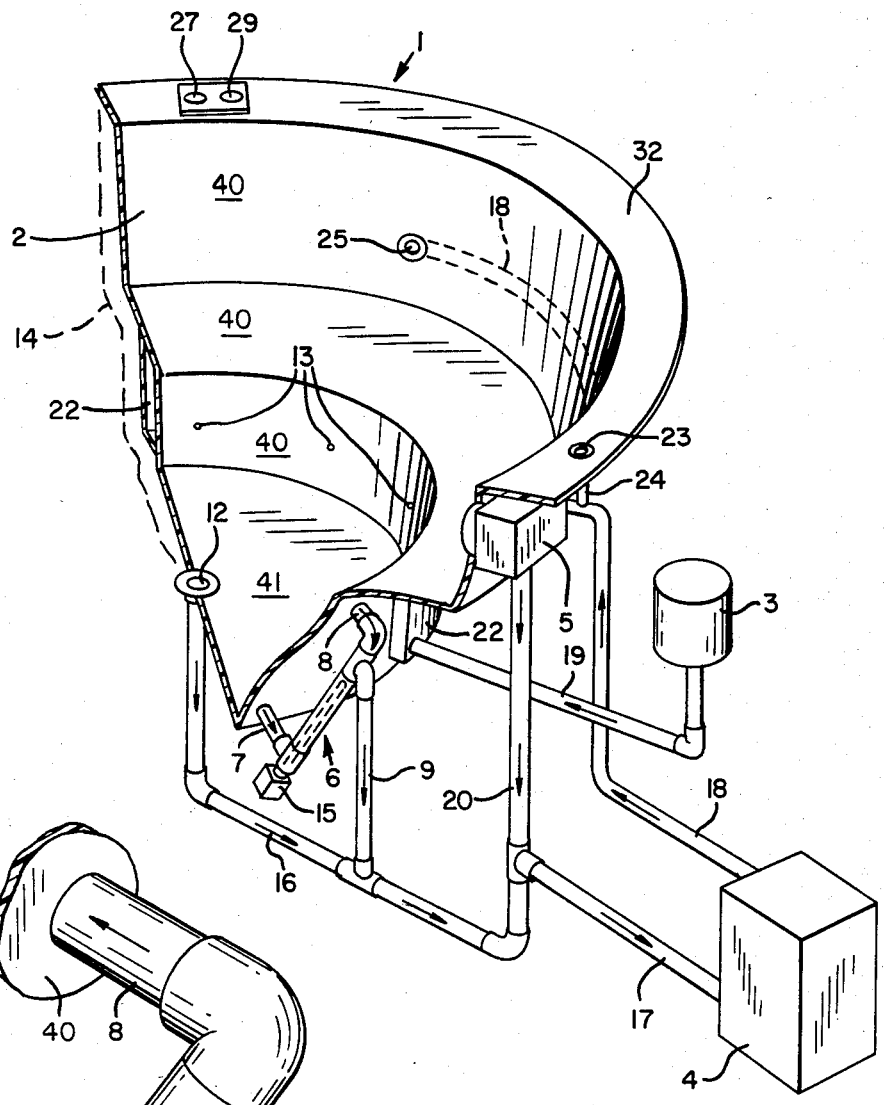
FIG. 1 is a cut away perspective view of the spa with the arrows showing water and air flow with the pump and air blower operating.

Turning now to FIG. 1, the spa 1 with spa top surface 32 is shown with the spa shell 2 which is covered by blown on foam insulation 14. The spa 1 has at least one continuous spa shell side surface 40 and a spa shell bottom 41. An air blower 3 by means of air pipe 19 is connected to the air manifold 22 which communicates with the bubble inlets 13. The pump 4 is connected to the water jets 25 where the air inlet 23 by means of air inlet pipe 24 communicates with the pump pipe 18, thus providing a mixture of water and air at the water jets 25.

The skimmer 5 is shown which filters the water. The thermosyphoning unit 6 is attached to the spa shell 2 so that the hot outlet pipe 8 is located above the cold inlet pipe 7. The drain 12 is connected by means of the drain pipe 16 and the suction pipe 17 to the pump 4. The thermosyphoning unit 6 is connected by means of a thermosyphoning pipe 9 which joins with the drain pipe 16 prior to entering the suction pipe 17. The skimmer 5 through skimmer pipe 20 connects with suction pipe 17. The arrows show the water flow to and from the pump 4 and show the air flow from the air blower 3 to the air manifold 22. The blower air switch 27 connects to the air blower 3. The pump air switch 29 connects to the pump 4.

Figure 2:
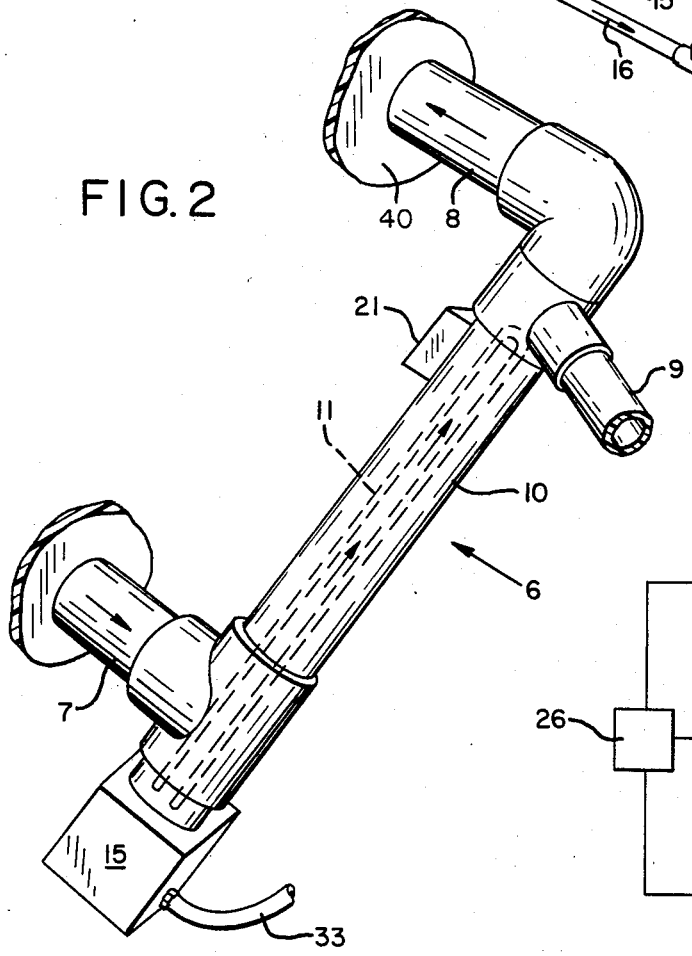
FIG. 2 is a perspective view of the thermosyphoning unit with the heating element in ghost lines and the arrows showing water flow when the heating element only is operating.

In FIG. 2, the thermosyphoning unit 6 is detailed. The cold inlet pipe 7 slants above the horizontal from the spa shell 2 to the heating pipe 10. The heating pipe 10 slants above the horizontal from the cold inlet pipe 7 to the hot outlet pipe 8. The hot outlet pipe 8 slants above the horizontal from the heating pipe 10 to the spa shell 2. The thermosyphoning pipe 9 is attached to the heating pipe 10 just below the hot outlet pipe 8. An electrical wire 33 provides electrical current to the heating element 11 through the heat base 15. The high limit switch 21 is attached to the heating pipe 10 over the top of the heating element 11. The arrows show the water flow when the heating element 11 only is operating.

Figure 3:
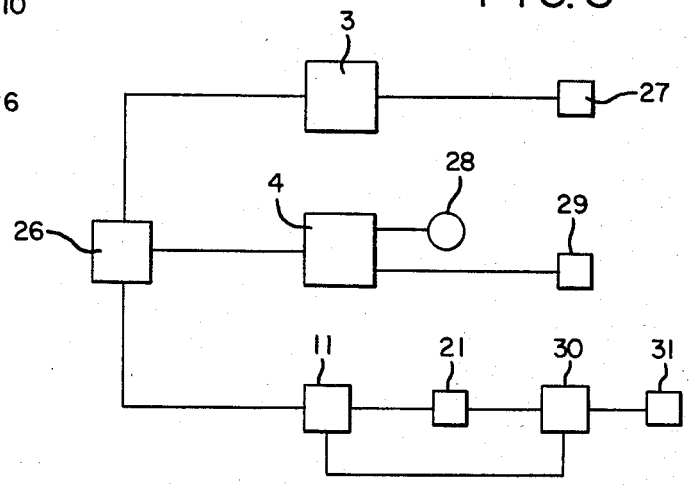
FIG. 3 is a block diagram of the operating equipment.

FIG. 3, in block diagram, shows the electrical and mechanical connections. A power source 26, which is usually from the home wiring system, attaches directly to the air blower 3 which is operated mechanically by a blower air switch 27 located on the spa 1. The power supply 26 is also directly wired to the pump 4 which in turn is wired to a timer 28 and mechanically connected to a pump air switch 29. The power source 26 is directly wired to the heating element 11, the limit switch 21, and the thermostat 30. The thermostat setting 31 for low temperature and high temperature setting is remotely wired from the thermostat 30.

In operaion, after the minimum temperature and maximum temperature of the spa has been set on the thermostat setting 31, the heating element 11 will either go off or on as the thermostat 30 indicates. This is done without necessity of the pump 4 running. If the temperature within the heating pipe 10 exceeds a pre-determined limit, preferrably 120° F., the limit switch 21 breaks the circuit thus shuting off the heating element 11. As can readily be seen in FIG. 3, whether the pump 4 and/or blower 3 are running, the heating element 11 will be independently controlled.

When the heating element is on, the water tends to heat and, by the well known effect of thermosyphoning or water stratification by temperature, the heated water rises through heating pipe 10. The hot outlet pipe 8 is slanted above the horizontal from the heating pipe 10. Thus the heated water will rise into the spa 1 itself. As the heated water is rising through heating pipe 10 and hot outlet pipe 8, fresh colder water is drawn in through cold inlet pipe 7 which is slanted upwards from the spa wall 2. The same thermosyphoning process takes place and the water is continuously heated without running either the pump or the air blower. The flow of water through the thermosyphoning unit 6 is a smooth continuous flow because the cold inlet pipe 7, heating pipe 10 and hot outlet pipe are slanted above the horizontal. Prior art uses horizontal piping for the inlet and outelt to and from thermosyphoning mechanisms with resultant impaired flow at the inlet and outlet. In addition, most prior thermosyphoning mechanisms are vertical which transfers the least amount of heat to the water because the water can freely move through the heating unit. As shown in FIG. 2 in the preferred embodiment the heating pipe 10 is not vertical which forces the water to move more slowly absorping more heat from the heating element 11. Thus, more efficient heating occurs with a shorter heating element 11. Once the temperature of the water reaches the pre-set maximum limit on the thermostat setting 31, the heating element 11 will turn off. Should the temperature of the water in the heating pipe 10 increase above 120° F. the high limit switch 21 shuts the heating element 11 off.

When the pump 4 is turned on by means of pump air switch 29 water is drawn through the drain 12, the cold inlet pipe 7, the hot outlet pipe 8, and the skimmer 5. The water is drawn to the pump 4 by the thermosyphoning pipe 9, the drain pipe 16, the skimmer pipe 20, and, finally, into the pump itself by means of the suction pipe 17. This also provides a safety feature in the sense that the suction at each of the entry points is reduced. The prior art uses only the drain 12 and skimmer 5 as entry points. Thus, should a small child be in the spa unsupervised, the suction from the drain will not be sufficient to hold the child under water because of the other three inlets at the skimmer 5, hot outlet pipe 8, and cold inlet pipe 7. As can be readily seen, the heating element 11 may be on or off during the pumping cycle. Only if the temperature controlled by the thermostat setting 31 is less than the pre-set minimum will the heating element 11 be on. If the pump 4 and heating element 11 are on at the same time, the heated water will flow into the thermosyphoning pipe 9, drain pipe 16, suction pipe 17, and through the pump 4 and pump pipe 18 before returning to the spa 1 by means of the water jets 25. Note that the water flow in hot outlet pipe 8 is reversed when both the pump 4 and heating element 11 are on. In other words, the pump's 4 suction force is greater that the thermosyphoning effect. Also, the air inlet 23 provides air from the atmosphere to the pump pipe 18 by means of air inlet pipe 24. Thus both air and water exit from the water jets 25. The timer 28 is used to turn the pump 4 on when it is expected the water contained in thermosyphoning pipe 9, drain pipe 16, suction pipe 17, skimmer pipe 20, and pump pipe 18 is significantly colder than the water in spa 1.

The air blower 3 is turned on by the blower air switch 27. Air is forced by the air blower 3 into air pipe 19 and into the air manifold 22. The air exists through the bubble inlets 13 and rises to the top of the spa 1.

Because of the insulation 14 around the spa shell 2, the temperature of the water remains fairly constant with low heat loss. Of course, an insulated top is provided which rest upon the spa top surface 32 (the top is not shown).

The amount of remote plumbing requiring the pump 4 and heating unit to be directly connected is eliminated. The size of the installation is substantially reduced because of the positioning of the thermosyphoning unit 6.

Although we have described our invention in specific terms, it will be understood that variations may be made in size, shape, materials and arrangement without the departing from the spirit and scope of the invention as claimed.

We claim:

1. A spa comprising:

(a) A spa shell having at least one continuous connected spa shell side surface and a spa bottom;

(b) an air blower attached to said spa shell by means of an air pipe interconnected to an air manifold from which a plurality of bubble inlets communicate through said spa shell;

(c) a thermosyphoning unit where a heating pipe with a heating element within said heating pipe is attached to said side surface of said spa shell by means of a cold inlet pipe and a hot outlet pipe located above said cold inlet pipe wherein a plane passing through said cold inlet pipe and being perpendicular to said spa bottom will not pass through said hot outlet pipe;

(d) a one-speed pump circulating fluid from said spa shell by means of at least four inlets, namely, a drain, a skimmer, along with said cold inlet pipe and said hot outlet pipe of said thermosyphoning unit which communicate through said spa shell where said thermosyphoning unit, said drain by a drain pipe, and said skimmer by a skimmer pipe interconnect to said pump by means of a suction pipe and, further, where said pump provides fluid and air to a spa shell by means of a pump pipe to a plurality of water jets where an air inlet provides air to said pump pipe by means of air inlet pipe which communicates with the atmosphere through an air inlet.

2. The spa of claim 1 wherein said heating element operates independently of said pump circulating causing fluid from said spa shell to circulate through said cold inlet pipe, through said heating pipe, through said hot outlet pipe to said spa shell.

3. A spa as in claim 1, including a thermostat electrically connected to said heating element in said heating pipe an to a thermostat setting for upper and lower temperatures where a limit switch controls maximum temperature in said heating pipe.

4. A spa as in claim 1, including blown-on foam insulation on said spa shell exterior and insulating top on said spa shell.

* * * * *